US005497997A

United States Patent [19]

Nikas et al.

[11] Patent Number: 5,497,997

[45] Date of Patent: Mar. 12, 1996

[54] CAPTIVE-TRACK GAME APPARATUS

[76] Inventors: Dimitrios Nikas, 2891 8th Avenue, Port Alberni, British Columbia, Canada, V9Y 2K6; Harry Jakoncic, 2831 14th Avenue, Port Alberni, British Columbia, Canada, V9Y 2X4

[21] Appl. No.: 421,527

[22] Filed: Apr. 13, 1995

[51] Int. Cl.[6] ..... A63F 3/00

[52] U.S. Cl. ..... 273/264; 273/281

[58] Field of Search ..... 273/236, 264, 273/271, 281, 282.1

[56] References Cited

U.S. PATENT DOCUMENTS

| | | | |
|---|---|---|---|
| 1,085,941 | 2/1914 | Russell | 273/281 |
| 1,700,016 | 1/1929 | Belanger | 273/281 X |
| 2,398,726 | 4/1946 | Seguin | 273/264 |
| 3,130,972 | 4/1964 | Schwarzlander | 273/264 |
| 3,693,976 | 9/1972 | Flack . | |
| 4,111,418 | 9/1978 | De Ment, Jr. . | |
| 4,239,230 | 12/1980 | Shoptaugh . | |
| 4,486,017 | 12/1984 | Evert | 273/281 X |
| 4,522,408 | 6/1985 | McKee . | |
| 5,069,458 | 12/1991 | Washington . | |
| 5,333,877 | 8/1994 | Pridgeon et al. | 273/281 X |
| 5,427,379 | 6/1995 | Lee | 273/281 |
| 5,437,459 | 8/1995 | Kirby | 273/281 X |

FOREIGN PATENT DOCUMENTS

| | | | |
|---|---|---|---|
| 388562 | 9/1990 | European Pat. Off. | 273/264 |

*Primary Examiner*—William E. Stoll

[57] ABSTRACT

A game apparatus includes a game board assembly which includes a base portion and a plurality of piece-guidance portions located on top of the base portion. The piece-guidance portions include bottom guiding portions supported by the base portion and include top guiding portions supported by the bottom guiding portions. The top guiding portions extend outward beyond the bottom guiding portions, such that grooves are formed by the top guiding portions, the bottom guiding portions, and the base portion. The piece-guidance portions are spaced apart from each other on the base portion so that guidance channels are provided between adjacent piece-guidance portions and so that game-piece-reception areas are provided at selected positions on the base portion. A plurality of game pieces are adapted to be placed on the base portion. Each game piece includes a foot portion, a body portion, and a head portion. Each foot portion is sized to be received by the game-piece-reception areas and the grooves on the base portion. Each body portion is sized to be received by and guided by the guidance channels. The head portions of the game pieces are color coded and preferably, mushroom shaped. The piece-guidance portions are arranged on the game board assembly to provide a grid arrangement of intersecting vertical, horizontal, and diagonal guidance channels. The game-piece-reception areas are positioned on the base portion of the game board assembly at positions wherein at least three piece-guidance portions converge.

9 Claims, 3 Drawing Sheets

FIG 1
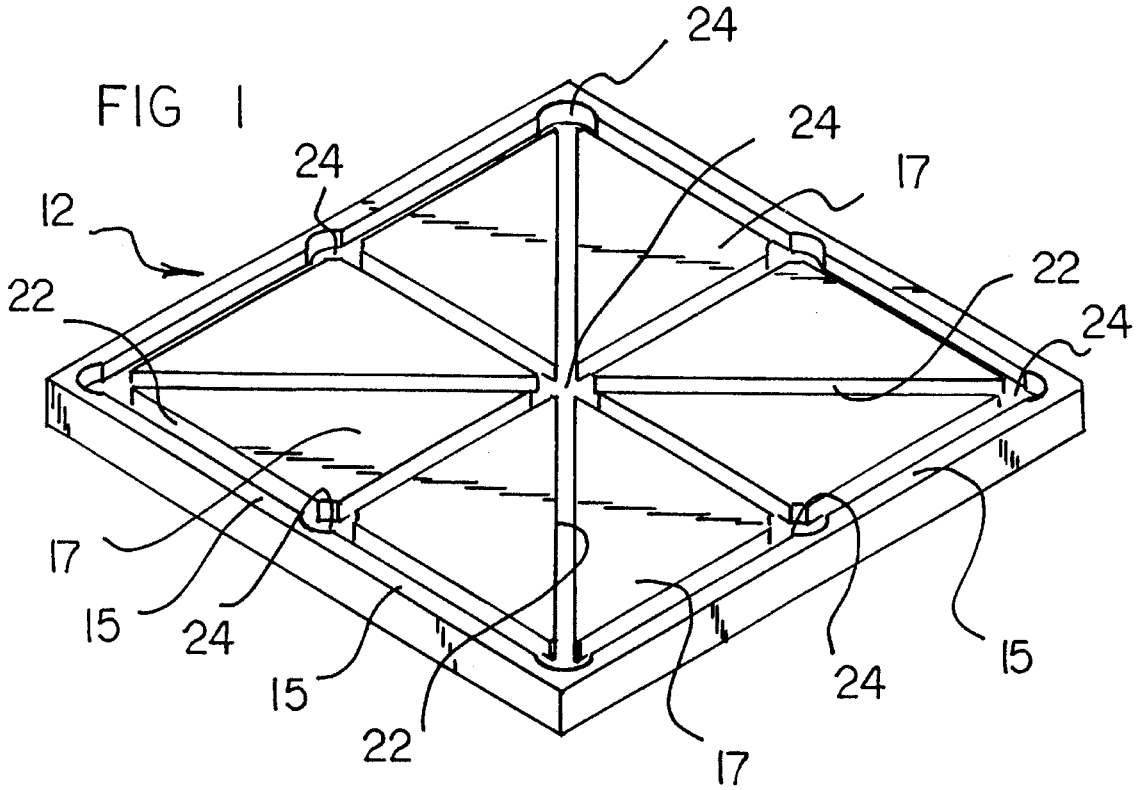
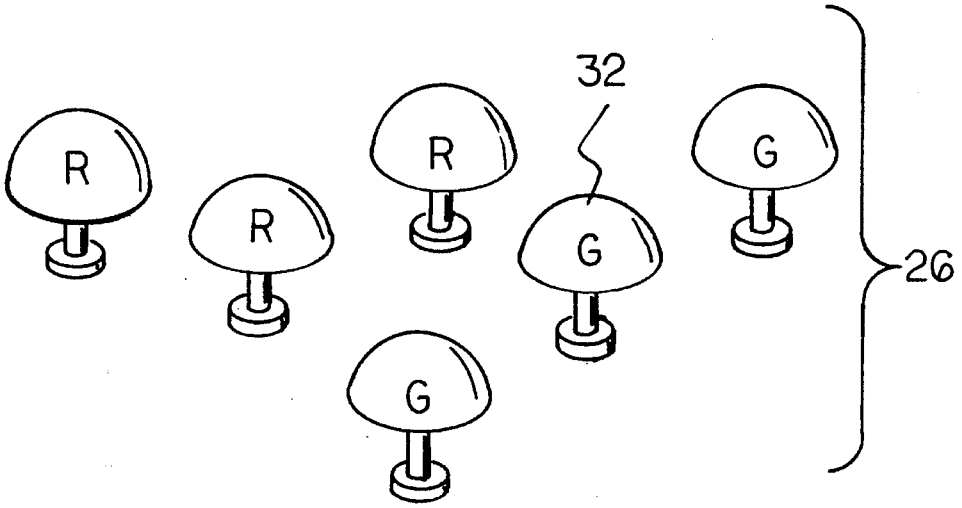
FIG 2

CAPTIVE-TRACK GAME APPARATUS

BACKGROUND OF THE INVENTION

1. Field of the Invention

The present invention relates generally to recreational games and, more particularly, to games that include a board and a plurality of movable pieces.

2. Description of the Prior Art

Many board games are on the market which share a common deficiency. The pieces placed on the game board are easily displaced from their desired game board positions. If a game board is inadvertently jostled, the pieces can be displaced so as to completely disturb the status and progress of the game. In this respect, it would be desirable if a board game were provided with game pieces that were not readily displaced from game board positions if the board is jostled.

There are board games which include magnetic boards and magnetic pieces. The attraction between the magnetic board and the magnetic pieces may be sufficient to prevent the pieces from being displaced from the board when the board is tilted slightly or lightly jostled, however such magnetic attraction is generally insufficient to withstand a relatively strong jostle. In this respect, it would be desirable if a board game were provided with game pieces that were more securely attached to a game board than by a magnetic attraction between the pieces and the board.

A game, though not a board game, that has enduring popularity through the years is the game of tic-tat-toe. In this game, a win takes place when either three "X's" or three "O's" are arranged in a straight line. In view of the popularity of tic-tat-toe, it would be desirable if a board game were provided with game pieces wherein the object of the game is to arrayed three pieces of one kind in a straight line.

There are games which include game boards that include wells for receiving pegs. With such games, each of the wells is independent of the other wells. Therefore, to move a peg from one well to another well, the peg must be lifted out of one well, carried to the other well, and placed within the other well. When the peg is lifted out, it may be dropped or lost. In this respect, it would be desirable if a board game were provided with a board that included wells for receiving game pieces and that included means for moving the game pieces from one well to another without lifting and carrying the pieces.

Throughout the years, a number of innovations have been developed relating to games that include wells and pieces that fit into the wells, and the following U.S. patents are representative of some of those innovations: U.S. Pat. Nos. 3,693,976; 4,111,418; 4,239,230; 4,522,408; and 5,069,458. More specifically, all of the above-cited patents disclose games in which wells and pegs are employed and in which pegs must be lifted out of one well and carried to another well in order to place the peg in the other well.

Thus, while the foregoing body of prior art indicates it to be well known to use board games having game pieces attracted to or connected to the game board, the prior art described above does not teach or suggest a game apparatus which has the following combination of desirable features: (1) provides game pieces that are not readily displaced from game board positions if the board is jostled; (2) provides game pieces that are more securely attached to a game board than by a magnetic attraction between magnetic game pieces and a magnetic game board; (3) provides a board game wherein the object of the game is to array three game pieces of one kind in a straight line; and (4) provides a game board that includes wells for receiving game pieces and that includes means for moving the game pieces from one well to another without lifting and carrying the pieces. The foregoing desired characteristics are provided by the unique captive-track game apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a game apparatus which includes a game board assembly which includes a base portion and a plurality of piece-guidance portions located on top of the base portion. The piece-guidance portions include bottom guiding portions supported by the base portion and include top guiding portions supported by the bottom guiding portions. The top guiding portions extend outward beyond the bottom guiding portions, such that grooves are formed by the top guiding portions, the bottom guiding portions, and the base portion. The piece-guidance portions are spaced apart from each other on the base portion so that guidance channels arc provided between adjacent piece-guidance portions and so that game-piece-reception areas arc provided at selected positions on the base portion. The guidance channels have a smaller width than the game-piece-reception areas. A plurality of game pieces arc adapted to be placed on the base portion, wherein each of the game pieces includes a foot portion, a body portion extending upward from the foot portion, and a head portion supported by the body portion. Each foot portion is sized to be received by the game-piece-reception areas and the grooves on the base portion. Each body portion is sized to be received by and guided by the guidance channels provided by the piece-guidance portions. The head portions of the game pieces arc color coded. Preferably, the head portion arc mushroom shaped. The foot portion is preferably cylindrically shaped. The body portion is cylindrically shaped and fits into a center portion of the cylindrically shaped foot portion.

A plurality of the piece-guidance portions are substantially linear members and form a frame for the game board assembly. Also, a plurality of the piece-guidance portions are in a shape of right triangles. The linear members and the right triangles are arranged on the base portion of the game board assembly to provide a grid arrangement of guidance channels which includes intersecting vertical, horizontal, and diagonal guidance channels. The game-piece-reception areas are positioned on the base portion of the game board assembly at positions wherein at least three piece-guidance portions converge.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved captive-track game apparatus which has all of the advantages of the prior art and none of the disadvantages.

It is another object of the present invention to provide a new and improved captive-track game apparatus which may be easily and efficiently manufactured and marketed.

It is a further object of the present invention to provide a new and improved captive-track game apparatus which is of durable and reliable construction.

An even further object of the present invention is to provide a new and improved captive-track game apparatus which is susceptible of a low cost of manufacture with regard to both materials and labor, and which accordingly is then susceptible of low prices of sale to the consuming public, thereby making such captive-track game apparatus available to the buying public.

Still yet a further object of the present invention is to provide a new and improved captive-track game apparatus which provides game pieces that are not readily displaced from game board positions if the board is jostled.

Still another object of the present invention is to provide a new and improved captive-track game apparatus that provides game pieces that are more securely attached to a game board than by a magnetic attraction between magnetic game pieces and a magnetic game board.

Yet another object of the present invention is to provide a new and improved captive-track game apparatus which provides a board game wherein the object of the game is to array three game pieces of one kind in a straight line.

Even another object of the present invention is to provide a new and improved captive-track game apparatus that provides a game board that includes wells for receiving game pieces and that includes means for moving the game pieces from one well to another without lifting and carrying the pieces.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a perspective view showing a preferred embodiment of a game board for the captive-track game apparatus of the invention.

FIG. 2 is a perspective view of a plurality of game pieces used with the game board shown in FIG. 1.

DESCRIPTION OF THE PREFERRED EMBODIMENT

Figure 3:
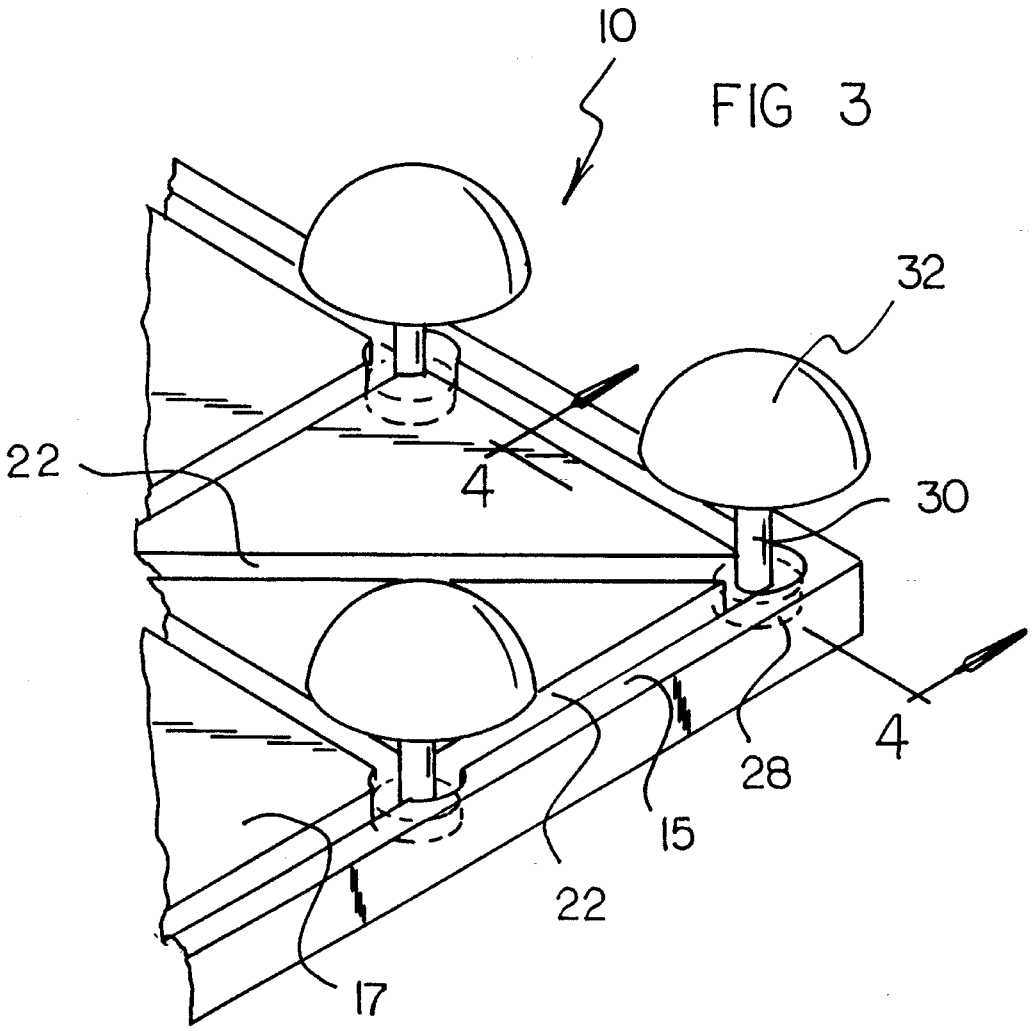
FIG. 3 is an enlarged perspective view of a portion of the game board shown in FIG. 1 having a plurality of game pieces shown in FIG. 2 attached thereto.
Figure 4:
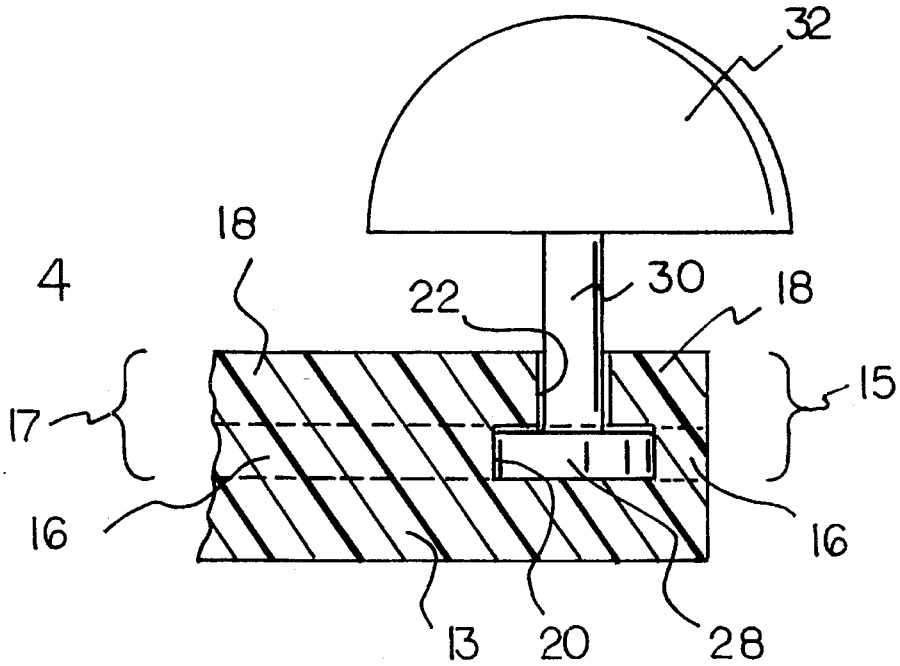
FIG. 4 is an enlarged cross-sectional view of a portion of the game board and a game piece shown in FIG. 3 taken along line 4—4 of FIG. 3.

With reference to the drawings, a new and improved captive-track game apparatus embodying the principles and concepts of the present invention will be described.

Turning to FIGS. 1–6, there is shown an exemplary embodiment of the captive-track game apparatus of the invention generally designated by reference numeral 10. In its preferred form, captive-track game apparatus 10 includes a game apparatus 10 which includes a game board assembly 12 which includes a base portion 13 and a plurality of piece-guidance portions 15, 17 located on top of the base portion 13. The piece-guidance portions 15, 17 include bottom guiding portions 16 supported by the base portion 13 and include top guiding portions 18 supported by the bottom guiding portions 16. The top guiding portions 18 extend outward beyond the bottom guiding portions 16, such that grooves 20 are formed by the top guiding portions 18, the bottom guiding portions 16, and the base portion 13. The piece-guidance portions 15, 17 are spaced apart from each other on the base portion 13 so that guidance channels 22 are provided between adjacent piece-guidance portions 15, 17 and so that game-piece-reception areas 24 are provided at selected positions on the base portion 13. The guidance channels 22 have a smaller width than the game-piece-reception areas 24. A plurality of game pieces 26 are adapted to be placed on the base portion 13, wherein each of the game pieces 26 includes a foot portion 28, a body portion 30 extending upward from the foot portion 28, and a head portion 32 supported by the body portion 30. Each foot portion 28 is sized to be received by the game-piece-reception areas 24 and the grooves 20 on the base portion 13. Each body portion 30 is sized to be received by and guided by the guidance channels 22 provided by the piece-guidance portions 15, 17. The head portions 32 of the game pieces 26 are color coded. Preferably, the head portion 32 are mushroom shaped. If desired, other shapes for the head portion 32 can be employed. The foot portion 28 is preferably cylindrically shaped. The body portion 30 is cylindrically shaped and fits into a center portion of the cylindrically shaped foot portion 28.

A plurality of the piece-guidance portions are substantially linear members 15 and form a frame for the game board assembly 12. Also, a plurality of the piece-guidance portions are in a shape of right triangles 17. The linear members 15 and the right triangles 17 are arranged on the base portion 13 of the game board assembly 12 to provide a grid arrangement of guidance channels 22 which includes intersecting vertical, horizontal, and diagonal guidance channels 22. The game-piece-reception areas 24 are positioned on the base portion 13 of the game board assembly 12 at positions wherein at least three piece-guidance portions converge.

Figure 5:
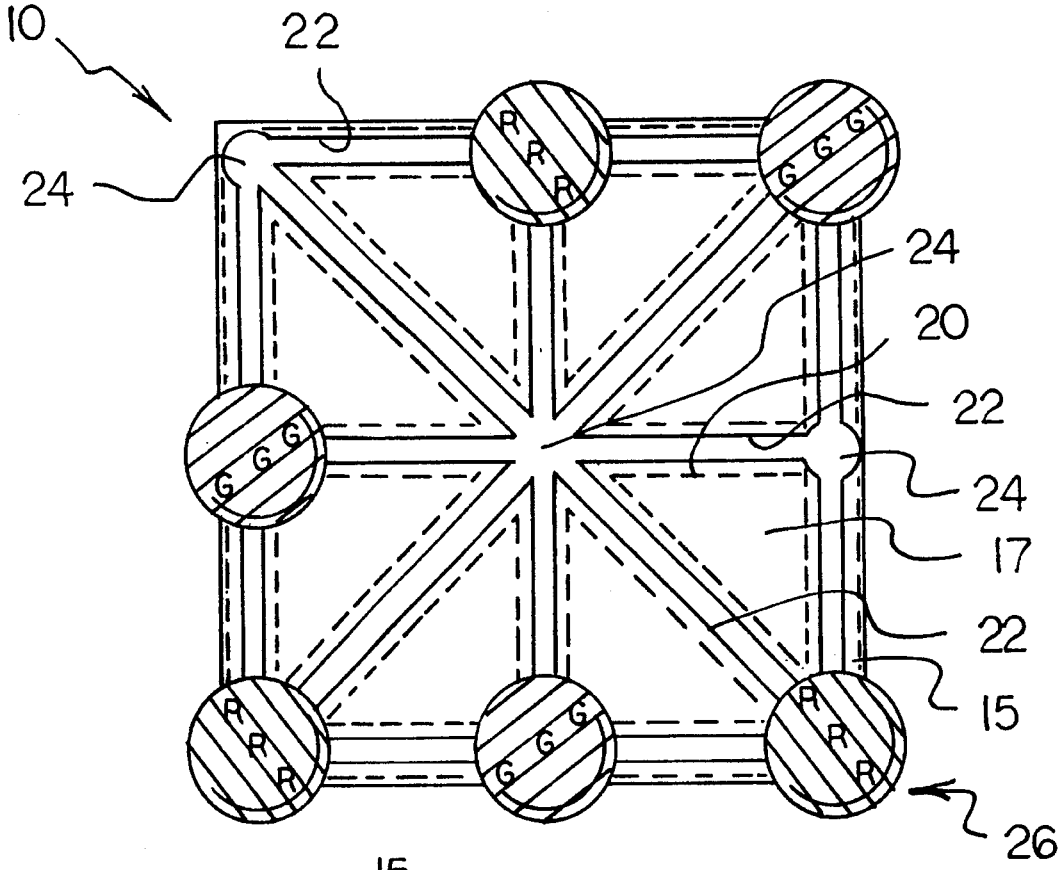
FIG. 5 is a top view of a game in progress in which neither red pieces nor green pieces are three-in-line on the game board.
Figure 6:
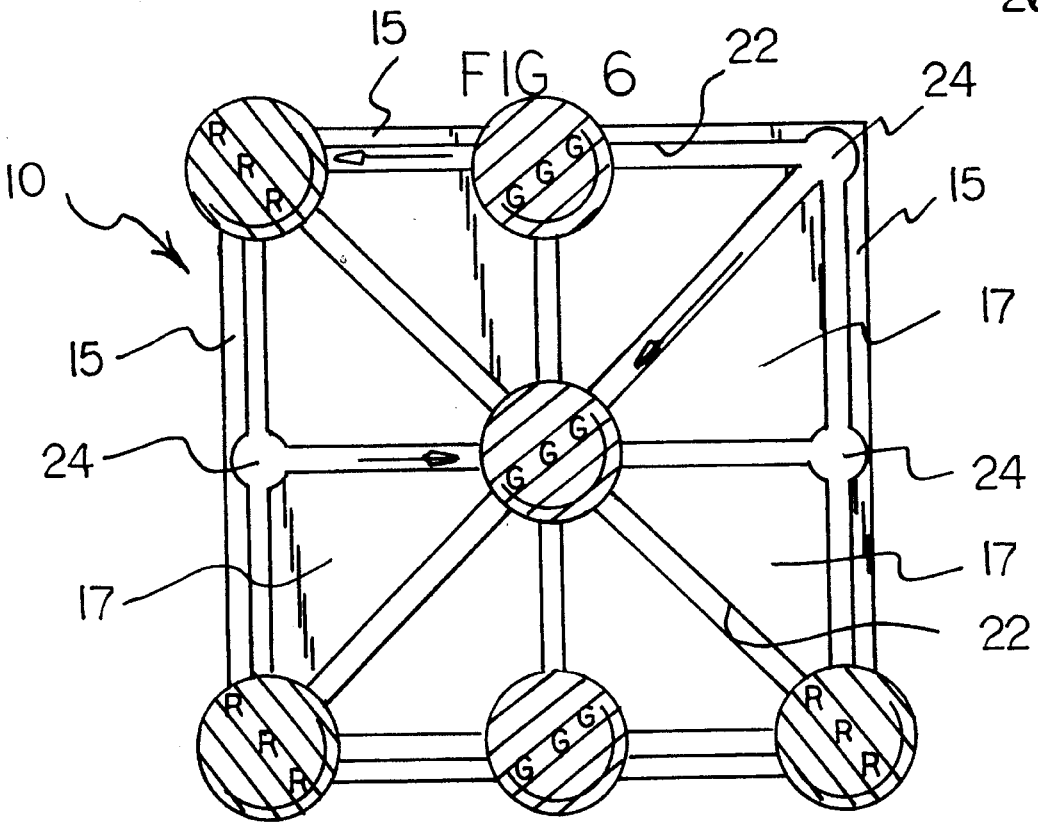
FIG. 6 is a top view of a game at its conclusion in which there are three-in-line of one color on the game board.

Since the preferred head portion 32 of the game pieces 26 is in the shape of a mushroom, a game in accordance with the invention can be called a mushroom game. There are two sets of color-coded mushroom game pieces 26. For convenience, three mushroom game pieces 26 are colored red which is indicated by the letter "R". In addition, three mushroom game pieces 26 are colored green which is indicated by the letter "G". The object of the mushroom game is to be the player with three mush:room game pieces 26 of the same color in a respective game-piece-reception area 24 a straight line, either diagonally, vertically, or horizontally. In playing the mushroom game, each player begins by placing a respective color-coded mushroom game piece 26 on a selected game-piece-reception area 24. The players alternate placement of their mushroom game pieces 26 on the game-piece-reception areas 24 until all of the mushroom game pieces 26 have been placed. If one of the players has three of the same-color-coded mushroom game pieces 26 in a straight line in three respective game-piece-reception areas 24, the game is over. However, if three of the same color mushroom game pieces 26 are not in a straight line, as shown in FIG. 5, then, by alternating turns, each player moves a selected mushroom game piece 26 that is the player's chosen color along a selected guidance channel 22 until three of the same color mushroom game pieces 26 are in a straight line, in respective game-piece-reception areas 24, as shown in FIG. 6 wherein three green mushroom game pieces 26 are in a straight line. Therefore, the winner of the game shown in FIG. 6 is the player who has the green mushroom game pieces 26.

It is noted that when a foot portion 28 of a game piece 26 is in a groove 20, the game piece 26 cannot separated from the game board assembly 12 even if the game board assembly 12 were jostled or turned upside down. The top guiding portions 18 of the piece-guidance portions 15, 17 of the game board assembly 12 prevent the foot portion 28 of the game piece 26 from separating from the game board assembly 12. In essence, each foot portion 28 of a game piece 26 forms a tongue that fits in the grooves 20, and movement of the tongue within the grooves is guided by the guidance channels 22.

The components of the captive-track game apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved captive-track game apparatus that is low in cost, relatively simple in design and operation, and which may advantageously be used to provide game pieces that are not readily displaced from game board positions if the board is jostled. With the invention, a captivetrack game apparatus provides game pieces that are more securely attached to a game board than by a magnetic attraction between magnetic game pieces and a magnetic game board. With the invention, a captive-track game apparatus provides a board game wherein the object of the game is to array three game pieces of one kind in a straight line. With the invention, a captive-track game apparatus provides a game board that includes wells for receiving game pieces and that includes means for moving the game pieces from one well to another without lifting and carrying the pieces.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by LETTERS PATENT of the United States is as follows:

1. An alignment game apparatus, comprising:

a game board assembly which includes a base portion and a plurality of piece-guidance portions located on top of said base portion, wherein said piece-guidance portions include bottom guiding portions supported by said base portion and include top guiding portions supported by said bottom guiding portions, wherein said top guiding portions extend outward beyond said bottom guiding portions, such that grooves are formed by said top guiding portions, said bottom guiding portions, and said base portion, wherein said piece-guidance portions are spaced apart from each other on said base portion so that guidance channels are provided between adjacent piece-guidance portions and so that game-piece-reception areas are provided at selected positions on said base portion, wherein said guidance channels have a smaller width than said game-piece-reception areas, and a plurality of game pieces adapted to be placed on said base portion, wherein each of said game pieces includes a foot portion, a body portion extending upward from said foot portion, and a head portion supported by said body portion, wherein each foot portion is sized to be received by said game-piece-reception areas and said grooves on said base portion, wherein each body portion is sized to be received by and guided by said guidance channels provided by said piece-guidance portions.

2. The apparatus of claim 1 wherein said head portions of said game pieces are color coded.

3. The apparatus of claim 1 wherein said head portions are mushroom shaped.

4. The apparatus of claim 1 wherein said foot portion is cylindrically shaped.

5. The apparatus of claim 4 wherein said body portion is cylindrically shaped and fits into a center portion of said cylindrically shaped foot portion.

6. The apparatus of claim 1 wherein a plurality of said piece-guidance portions are substantially linear members and form a frame for said game board assembly.

7. The apparatus of claim 6 wherein a plurality of said piece-guidance portions are in a shape of right triangles.

8. The apparatus of claim 7 wherein said linear members and said right triangles are arranged on said base portion of said game board assembly to provide a grid arrangement of guidance channels which includes intersecting vertical, horizontal, and diagonal guidance channels.

9. The apparatus of claim 1 wherein said game-piece-reception areas are positioned on said base portion of said game board assembly at positions wherein at least three piece-guidance portions converge.

* * * * *